US005360527A

United States Patent [19]

Ribitch

[11] Patent Number: 5,360,527

[45] Date of Patent: Nov. 1, 1994

[54] RACKLESS RACK FOR ELECTROPLATING

[75] Inventor: Raymond W. Ribitch, Mount Pleasant, Mich.

[73] Assignee: Hitachi Magnetics Corp., Endmore, Mich.

[21] Appl. No.: 55,859

[22] Filed: Apr. 30, 1993

[51] Int. Cl.[5] ..... C25D 17/08

[52] U.S. Cl. ..... 204/297 R; 204/297 W

[58] Field of Search ..... 204/199, 286, 277 W, 204/212, 294 R

[56] References Cited

U.S. PATENT DOCUMENTS 3,740,323 6/1973 Miyata et al. ..... 204/222
3,972,798 8/1976 Palisin, Jr. ..... 204/297 W

FOREIGN PATENT DOCUMENTS 0083664 12/1956 Netherlands ..... 204/222

*Primary Examiner*—Kathryn Gorgos
*Attorney, Agent, or Firm*—Vineet Kohli

[57] ABSTRACT

A rack for electroplating contains a plurality of windows for receiving an article to be electroplated. The rack is rotatably mounted to a frame connected to a cathode of a power supply. A portion of the border of each window is made of a conductive article which is connected to the cathode via the frame. Mesh screens flank each side of the windows, retaining the article within its borders. A series of non-conductive drive gears rotate the rack, moving the article to different contact points along the window. During electroplating, the movement of the article insures that the entire surface of the article is plated, thereby avoiding rack marks. The window's conductive elements divert metal ions away from the edge of the article, thereby offsetting the natural buildup of ions along the edge and increasing surface uniformity. The ratio of the thickness of the window's conductive elements to the thickness of the article are adjusted to produce an edge to center ratio of less than one, equal to one, or more than one.

20 Claims, 9 Drawing Sheets

RACKLESS RACK FOR ELECTROPLATING

BACKGROUND OF THE INVENTION

The present invention relates to a rack for use in electroplating. Specifically, the present invention relates to a rotatable rack for shifting articles to be plated in an electroplating solution.

Electroplating is a surface treatment in which metallic ions in a solution containing a metal salt coat an electrode. The article being plated is connected to the cathode of a DC power supply, usually a motor-generator or a rectifier (the anode of the power supply is connected to an anode of metal having the same base metal as the metal salt).

When the article and base metal are submerged in the electroplating solution, current flows from the metal to the article in the form of metal salt ions. Once the ions reach the article, they plate on its surface, eventually forming a coating. At the same time, the metal anode decomposes, thereby balancing the number of ions in the electroplating solution.

Electroplating is particularly useful in forming protective coatings on magnets for disk drives. Typical disk drive magnets are composed of 65% iron, 30% neodymium, 0.5–2% dysprosium, and 1% boron. A difficulty with this type of magnet is that it is highly susceptible to oxidation, which tends to reduce magnetic properties over time. In addition, the oxidation produces microscopic particles on the surface of the magnet, which may dislocate and contaminate the disk drive. In order to prolong the life of both the magnet and the disk drive in which it is installed, the outer surface of the magnets are coated with an organic powder or metal. Metal coatings are preferred, since they have the added advantage of protecting the magnet form scratching or chipping.

One of the most sought after effects of electroplating a precision object such as a disk drive magnet is a uniform coating thickness over the entire surface of the article. The uniformity of a coating is measured in terms of the Edge to Center (E/C) ratio, which is the ratio of the thickness of the coating at the edge of a coated article to the thickness at its center. An article receiving an ideal uniform coating would have an E/C ratio of 1.

In practical applications, the varying current density in the electrolyte surrounding the article being coated makes it is extremely difficult to reach an E/C ratio of 1. In general, projections and edges of an article have a higher current density than recess or flat surfaces. This higher current density at the edges creates a stronger electric field, thereby attracting a greater number of metal ions than areas having a lower current density. The additional ions result in a thicker coating in the vicinity of the edges of an article than at the center, resulting in a high E/C ratio.

One conventional method for electroplating is rack plating, in which articles are suspended in the electroplating solution via hooks or supports. In one process for plating disk drive magnets, the article remains immersed in the solution for approximately 8 minutes. The E/C ratio of the resultant product is approximately 3 to 1.

A further drawback of rack plating is that the article is not coated at the locations where it meets the supports. These so-called "rack marks" must be manually "touched-up" with paint, incurring additional process time and extensive labor costs.

A second method for electroplating is known as barrel plating. Using this method, 50–100 pieces of article to be coated are immersed into a rotatable barrel containing an electroplating solution and a media to assist in the rotation, usually steel ball bearings. As the barrel rotates, articles are randomly shifted and plated. Since the articles are constantly moving due to the motion of the ball bearings, rack marks are averted.

A drawback of barrel plating is that during an individual plating sequence, articles are plated over only a fraction of their surface. Since the selection and placement of each article is random, the same areas may be plated over several times. This results in a lack of uniformity and an E/C ratio which is inferior to rack plating.

A further drawback of barrel plating is that, for the same number of articles which take 8 minutes to plate in rack plating, it can require 120–180 minutes to ensure that all parts of the article are plated to the same thickness. This is extremely undesirable when plating magnets, as the acidic nature of the solution tends to compromise magnetic properties over prolonged exposure. The total loss of magnetic flux using barrel plating is approximately 1.6%, which is far greater than rack plating, which suffers less than 0.5% loss.

Due to the high costs of rack point touch-ups, considerable effort has been devoted to modifying barrel plating to produce more uniform coatings. One such attempt consists of a three layer coating of nickel, cooper and nickel (copper tends to be highly uniform on application). This method requires three process steps, however, greatly increasing the processing period. In addition, the shifting between three sets of metal solutions requires added process control steps and increased chemical and energy costs.

Another attempt to modify the barrel plating process consists of decreasing the number of magnets placed in the barrel while increasing the amount of media. This method is effective for increasing uniformity, but has a reduced capacity compared to normal barrel plating.

OBJECTS AND SUMMARY OF THE INVENTION

It is accordingly an object of the present invention to provide a technique for plating articles that overcomes the drawbacks of the prior art.

It is a further object of the present invention to provide an apparatus for electroplating articles which has speed and uniformity superior to rack plating, but does not suffer from rack marks.

It is a still further object of the present invention to provide a system of electroplating which provides a treatment having an E/C ratio closer to 1 than the prior art.

The present invention comprises a frame supporting rotatable racks. The racks include conductive horizontal and non-conductive vertical cross-bars which intersect to form windows. The windows are covered on at least one side by a non-conductive mesh screens, for supporting the objects to be plated in isolated windows. When two mesh screens (one above and one below the windows) are used, one of the mesh screens is removable, allowing for the insertion and removal of articles to be electroplated.

A frame is connected to the rotatable rack by shafts which are driven by NYLON drive gears. These gears are connected to an external drive gear via NYLON drive chains. Rotation of the drive gear rotates the racks. An external control system regulates the period and angle of rotation.

Two copper conductors connect the frame to the cathode of a power supply. Together, the copper conductors, frame, shafts and horizontal cross bars form one large cathode against which the edges of the articles to be plated come into contact. The contact points are moved, either continuously, or discontinuously, by the motion of the rack. The continuous change in contact point between the articles to be plated and the edges of the windows avoids rack marks on the articles to be plated.

The present invention operates by placing an article to be plated inside each window of one or more racks. The racks are immersed in an electroplating solution and rotated such that gravity forces each article into contact with a conductive horizontal cross beam. The power supply is activated, and metal ions begin to coat the exposed areas of the article.

After a predetermined period, the rack is rotated such that the article falls from one conductive horizontal cross bar to another. Once contact is reestablished, plating resumes over the exposed areas, including the former contact point.

The above process is repeated until the article is plated to the desired thickness. As no one point on the surface of the article continuously contacts the borders of the window, all points along the surface receive plating. Rack marks are thus eliminated.

During the electroplating process, metal ions are drawn to the conductive horizontal cross bars in the same manner as they are drawn toward the article. The horizontal cross bars thus "steal power" by diverting ions away from high current density areas along the edge of the article. Since the edges of the article no longer have 100% of the ions available for plating, the coating along the extremities is thinner, thereby producing a more ideal E/C ratio. Indeed, the inventor has determined a functional relationship between the thickness of the cross bars and the E/C ratio, thereby permitting control of this ratio to any desired value, including 1:1.

According to an embodiment of the invention, there is provided an apparatus for supporting an article in an electroplating solution comprising a rack, said rack having at least one window, said window including at least first and second conductive portions on an inner perimeter thereof, means for retaining said article within said at least one window, means for rotating said rack between at least first and second predetermined operating positions, said means for rotating including means for permitting said article to move into contact with a point along said at least first and second conductive portions when said rack is in its first predetermined operating position, said means for rotating including means for permitting said article to move into contact with another point of said first and second conductive portions when said rack is in its second predetermined operating position, and means for connecting said at least first and second conductive portions to a cathode.

According to a further embodiment of the invention, there is provided an apparatus for supporting an article in an electroplating solution comprising a conductive frame, at least one rotatable rack mounted on said conductive frame, said rack having a plurality of conductive cross bars, said rack having a plurality of non-conductive cross bars, said plurality of non-conductive cross bars and said plurality of conductive cross bars intersecting to form at least one window for receiving an article, means for retaining said article in said at least one window, said at least one window containing at least one of said conductive cross bars, means for connecting said conductive cross bars to a cathode of a power supply, and means for rotating said at least one rotatable rack between first and second predetermined operating positions.

According to a still further feature of the invention there is provided an apparatus for supporting an article in an electroplating solution comprising a conductive frame, at least one rotatable rack, first and second shafts for mounting said rack to said frame, at least one of said first and second shafts being conductive, said rack including at least one vertical conductive support bar connected to said at least one of first and second shafts, said rack including horizontal conductive cross bars connected to said at least one vertical conductive support bar, said rack including vertical non-conductive cross bars, said horizontal conductive cross bars and said vertical non-conductive cross bars intersecting to form at least one window, said window having dimensions larger than a dimension of said article, at least one mesh screen covering said at least one window for supporting and retaining an article placed in said at least one window, means for connecting said conductive frame to a cathode, means for rotating said at least one rack between first and second operating positions, said first position being effective to cause said article to contact one of adjacent ones of said conductive horizontal cross bars, and said second operating position being effective to cause said article to contact another of said adjacent ones of said conductive horizontal cross bars.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5(*b*) is a front view of the window of FIG. 2 rotated to another rotational position.

FIG. 11(*b*) is a side view of the embodiment in FIG. 11(*a*) rotated to a second operating position.

DETAILED DESCRIPTION OF THE PREFERRED EMBODIMENT

Figure 1:
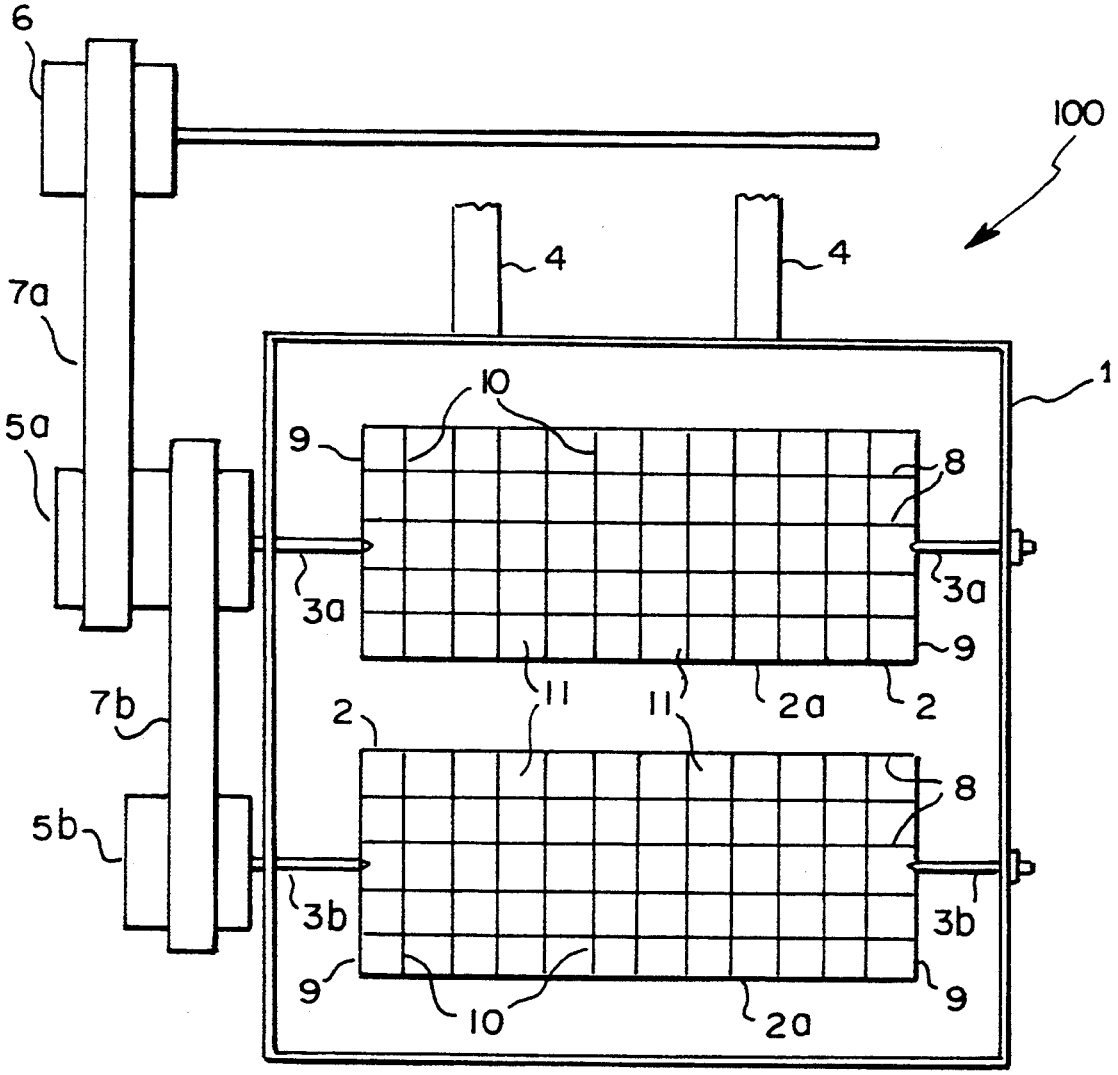
FIG. 1 is a front view of a plating rack according to an embodiment of the present invention.

Referring now to FIG. 1, a rack 100 includes a frame 1 supporting a pair of rotatable racks 2 via shafts 3*a* and 3*b*. Frame 1 is made of a conductive article, preferably copper, titanium or iron. Frame 1 is connected electrically to a cathode of an external power supply (not shown in FIG. 1) by conductors 4, which are also preferably made from copper, titanium or iron. One end of shafts 3*a* and 3*b* of each rotatable rack 2 is connected to NYLON drive gears 5*a* and 5*b*, respectively. A drive gear 6 is connected to drive gear 5*a* by a NYLON drive chain 7*a*. Drive gear 5*a* is connected to drive gear 5*b* by a NYLON drive chain 7*b*. Rotation of drive gear 6 rotates NYLON drive gears 5*a* and 5*b*, which in turn rotate rotatable racks 2.

Each rotatable rack 2 has a grid 2*a* consisting of horizontal bars 8 and vertical cross bars 10. The openings formed by grid 2*a* are windows 11. At least one, and preferably both, end vertical cross bars 10 are of conductive article electrically connected to frame 1 through shafts 3*a* and 3*b*. The remainder of vertical cross bars 10 are preferably non-conductive resin bars, but could be of metal. The non-conductive ones of vertical cross bars 10 may be of any suitable non-conducting article capable of tolerating the working environment such as, for example, acrylic resin or NYLON. All of horizontal bars 8 are conductive, and are connected at their ends to the conductive end vertical cross bars 10.

Figure 2:
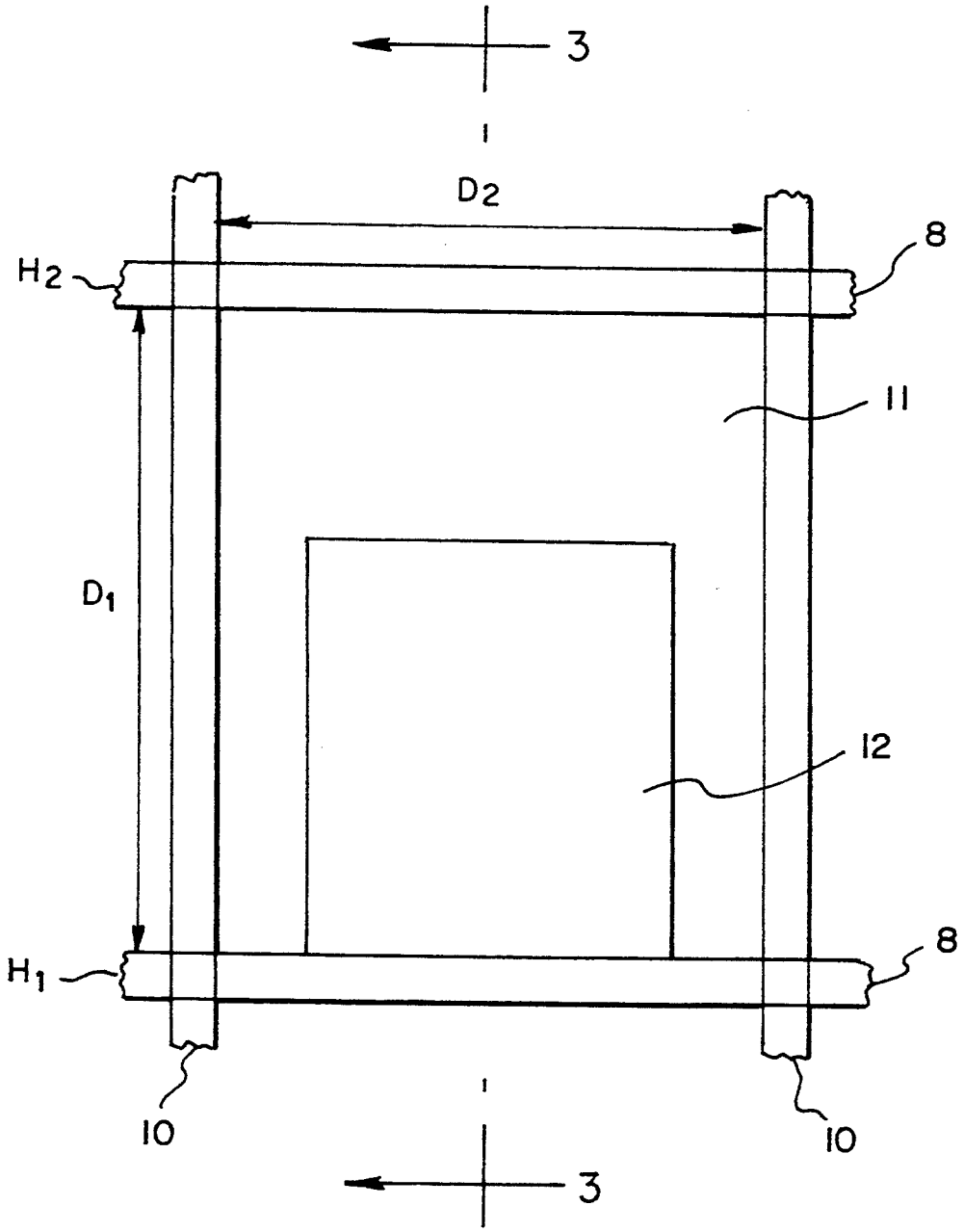
FIG. 2 is an enlarged view of one of the windows in the embodiment of FIG. 1.

Referring now to FIG. 2, adjacent horizontal cross bars H1 and H2 are spaced apart a distance D1. Adjacent vertical cross bar 10 are spaced apart a distance D2. An article 12 to be coated, is disposed in window 11. As rotatable racks 2 are tilted, article 12 moves into contact with the lower one of vertical cross bar 10 of the window 11. Distances D1 and D2 are larger than the dimensions of article 12, thereby allowing article 12 to move within the borders of window 11.

Figure 3:
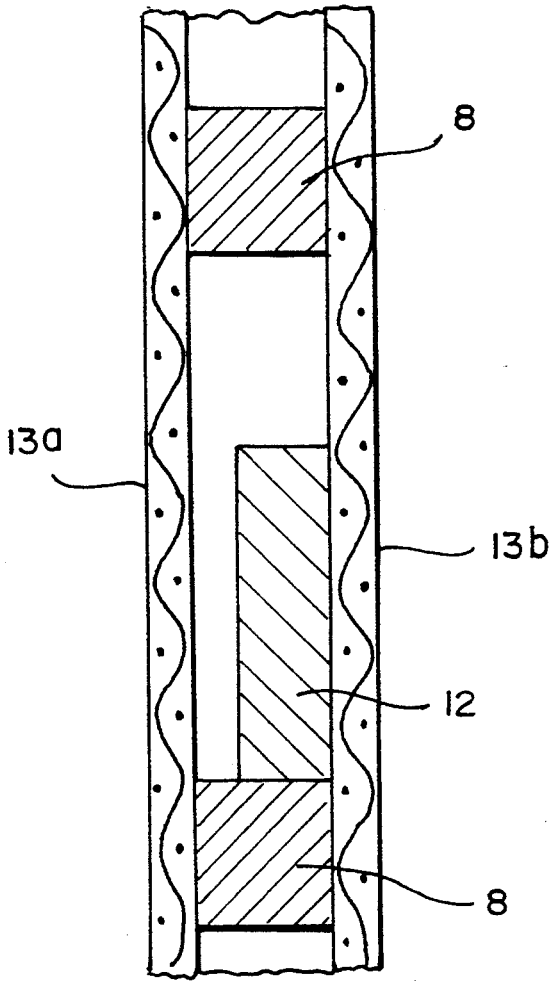
FIG. 3 is a cross section taken along III—III in FIG. 2.

Referring now to FIG. 3, rotatable rack 2 is covered on one or both sides by non-conductive mesh screens 13*a* and 13*b* (screens on both sides are shown, with the thickness of the screens exaggerated for illustrative purposes). Mesh screens 13*a* and 13*b* hold article 12 within the borders of window 11, and are porous enough to avoid interfering with the plating process.

Figure 4:
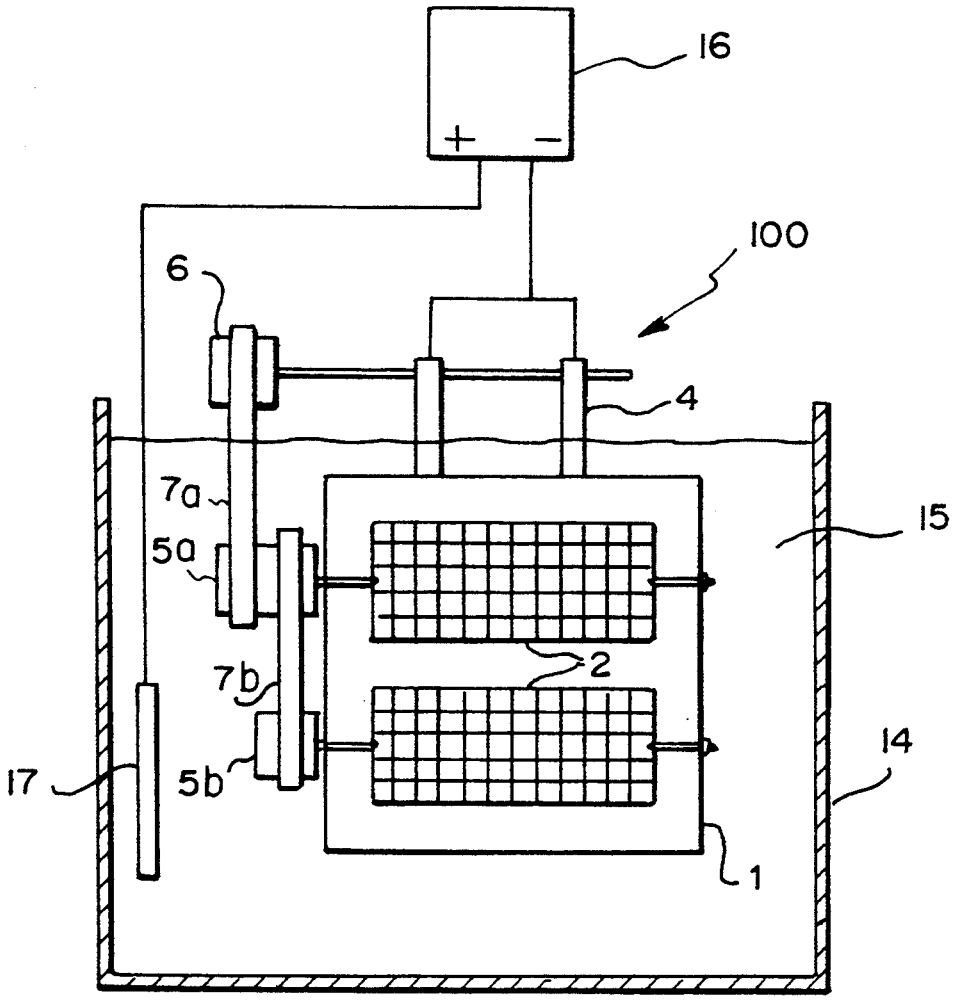
FIG. 4 is a cross section of a plating tank containing the plating rack of FIG. 1, together with other elements of the plating system.

Referring now to FIG. 4, rack 100 is submerged in a plating tank 14 containing a metal ion solution 15. A power supply 16 has its anode connected to a replenishing metal 17, of, for example, nickel or copper, submerged in tank 14. A cathode of power supply 16 is connected to copper conductors 4. A control unit (not shown) regulates power supply 16 and the rotation of rotatable racks 2 via a motor (not shown).

The rack 100 operates as follows. Mesh screen 13*a* is removed to permit placing articles 12 on mesh screen 13*b* within windows 11. Mesh screen 13*a* is replaced, sealing articles 12 within their respective windows 11. Once sealed, rotatable racks 2 are submerged into metal ion solution 15.

Figure 5A:
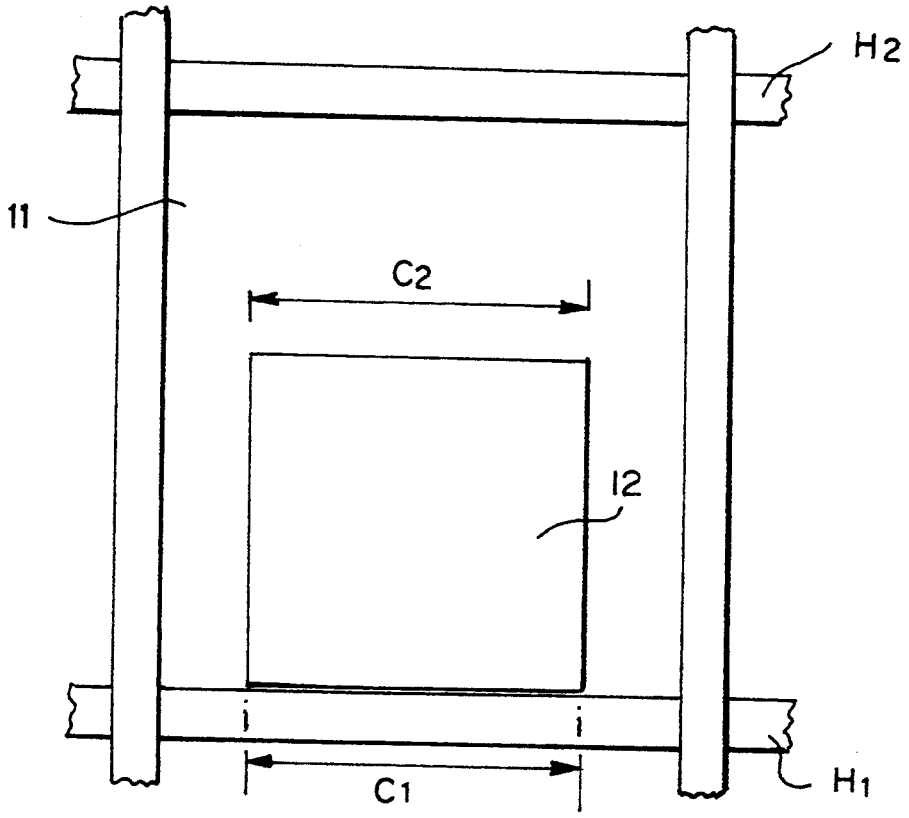
FIG. 5(*a*) is a front view of the window of FIG. 2, in one of its rotational positions.
Figure 5B:
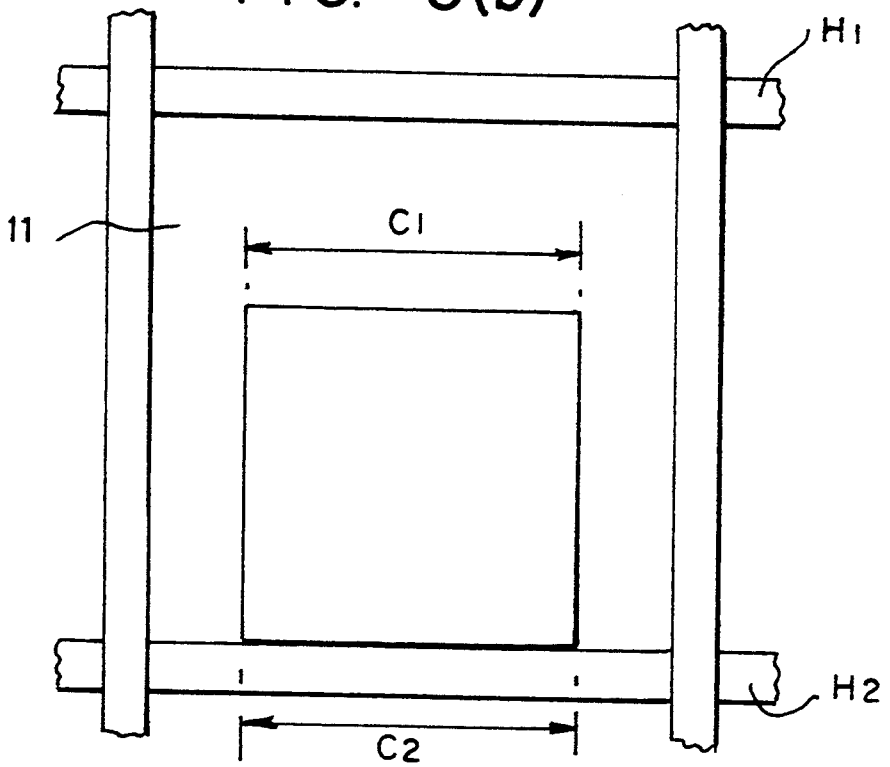

Referring now to FIG. 5(*a*), rotatable racks 2 are rotated such that the edge of each article 12 contacts a first horizontal member H1 at a first contact point C1. Power supply 16 is activated, and the metal of metal ion solution 15 begins to plate onto the exposed areas of articles 12. The electroplating process continues for approximately 30 seconds.

Referring now to FIG. 5(*b*), following the expiration of the immediate plating sequence, rotatable racks 2 are rotated a sufficient amount to permit articles 12 to slide down into contact with a now-lower horizontal crossbar H2 at a second contact surface C2. Since article 12 is not electrically connected with the cathode when it breaks contact with horizontal member H1, plating of article 12 discontinues momentarily until it reaches second horizontal member H2. Plating resumes once article 12 contacts second horizontal member H2. Metal also forms on first contact point C1, whereby first contact point C1 receives a suitable amount of plating.

The process of plating and rotating at 30 second intervals continues for approximately 7.5 minutes. If article 12 is square in shape, each contact point C1 and C2 receives plating for approximately half of that period, which is sufficient to insure all but a negligible loss in thickness. The resultant plated article is produced faster than conventional rack plating, yet does not suffer from rack marks.

Figure 6:
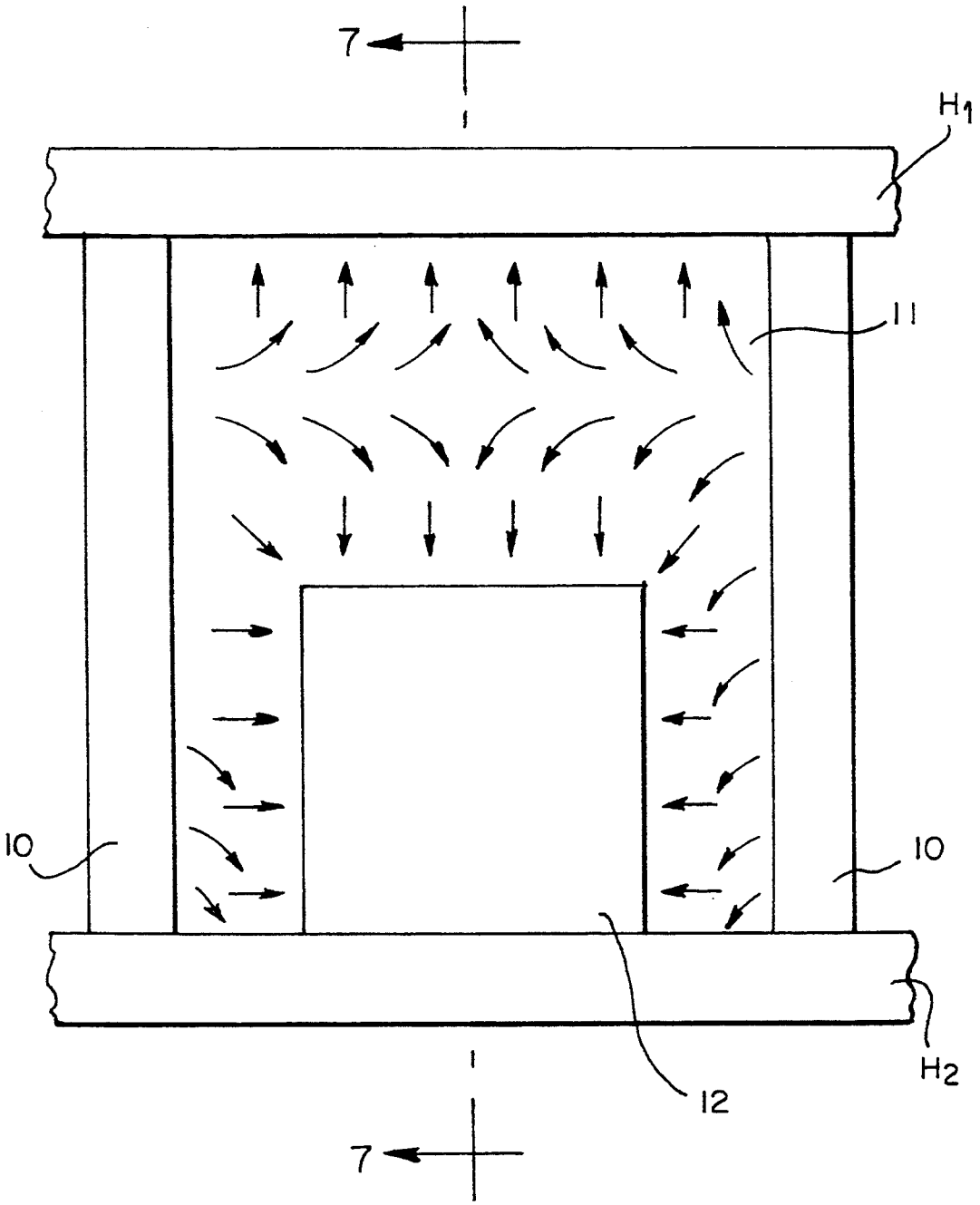
FIG. 6 is a front view of the window of FIG. 2, with ion flow during plating indicated by arrows.
Figure 7:
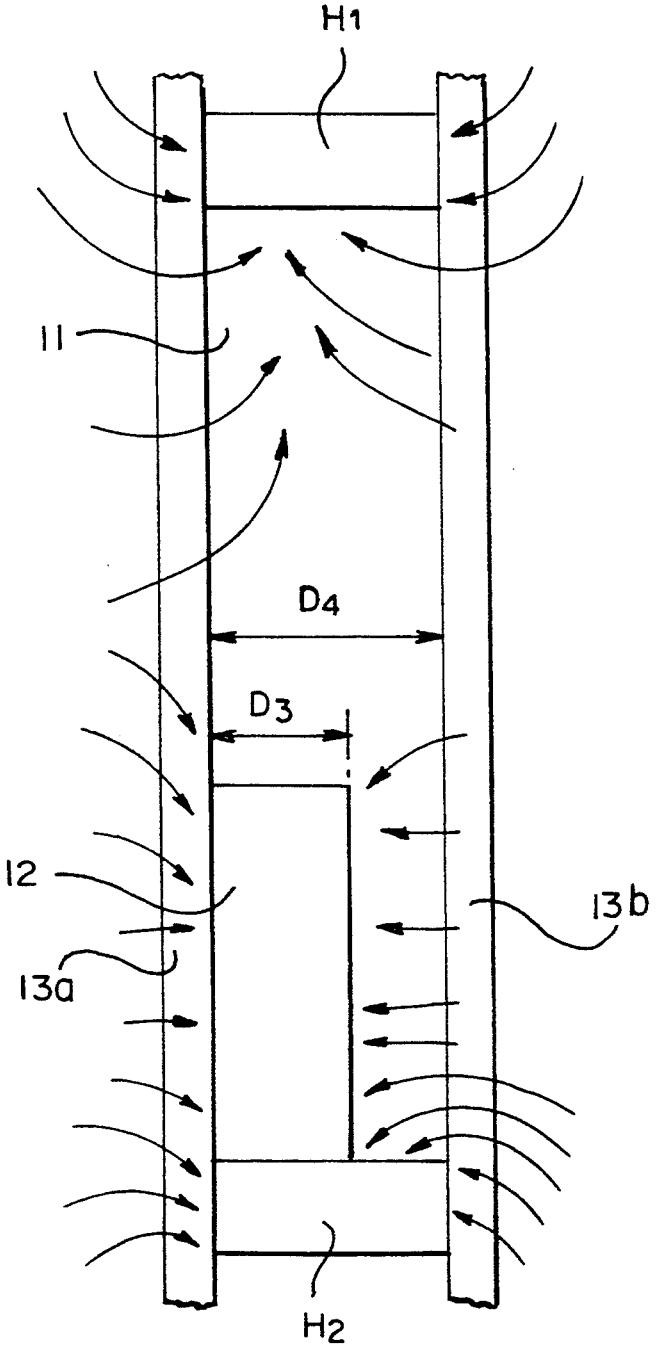
FIG. 7 is a cross section taken along VII—VII in FIG. 6.

Referring now to FIGS. 6 and 7, since horizontal members H1 and H2 are made of a conductive substance, they generate electric fields and are plated in the same manner as article 12. Due to their close proximity to the edges of article 12, the fields of horizontal members H1 and H2 overlap with the field produced by the high current density at the edges and corners of article 12. As a result, a number of the metal ions which would normally plate onto the edge of article 12 are diverted towards horizontal members H1 and H2. This results in reduced plating at the edges of article 12 close to horizontal members H1 and H2, as compared to the relatively undisturbed plating at the center of article 12.

This "stealing power" effect can best be seen in FIGS. 6 and 7, in which the arrows illustrate the movement of metal ions in solution 15. Article 12 has a thickness D3 and second horizontal cross bar H2 has a thickness D4. The greater the ratio D4/D3, the greater the number of ions that divert to coat horizontal cross bar H2 in favor of article 12. By reducing the number of ions available to plate the edges of article 12, the E/C ratio can be controlled as desired from greater than 1, equal to 1, or less than 1. By selecting a suitable D4/D3 ratio for a given thickness of article, and a suitable size and/or shape of windows 11, a desired E/C ratio can be attained.

EXAMPLE

Figure 8:
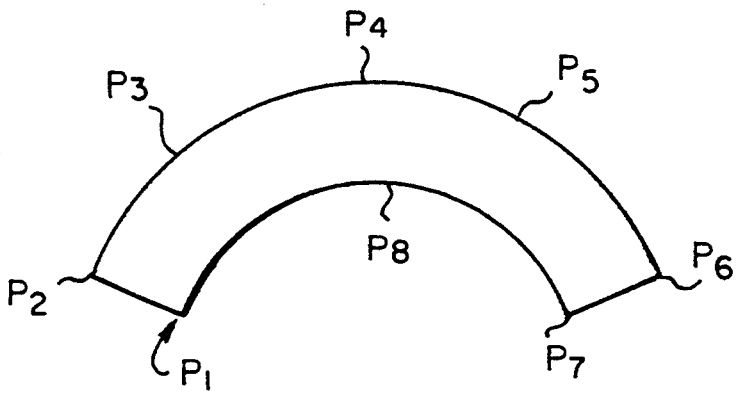
FIG. 8 is one type of magnet shape used in experiments showing the effect of window dimensions.

Referring now to FIG. 8, the rackless rack was used to plate a magnet having an arcuate shape. Eight points were measured for thickness following plating. The results were as follows:

| Location | E/C #1 | E/C #2 | E/C #3 |
|---|---|---|---|
| Center | 1.00 | 1.00 | 1.00 |
| P1 | 1.20 | 1.24 | 0.96 |
| P2 | 1.16 | 1.24 | 0.88 |
| P3 | 1.00 | 1.16 | 0.88 |
| P4 | 1.20 | 1.24 | 1.00 |
| P5 | 1.00 | 0.96 | 0.88 |
| P6 | 0.92 | 1.12 | 0.84 |
| P7 | 1.10 | 1.28 | 1.04 |
| P8 | 1.10 | 1.20 | 1.08 |

The above data yields an average E/C of 1.07 with a standard deviation of 0.13. This is superior to barrel plating and conventional rack type plating. The variability in E/C ratio from point to point on an article 12 can be reduced by reshaping windows 11 to conform more closely to the shape of article 12. That is, for the arcuate article 12 illustrated, improved uniformity of E/C ratio from point to point on the same article 12 may be obtainable using arcuate windows, whereby the distance from the edge of article 12 not contacting its adjacent conductive horizontal bar 10, is approximately equal along its length.

Figure 9:
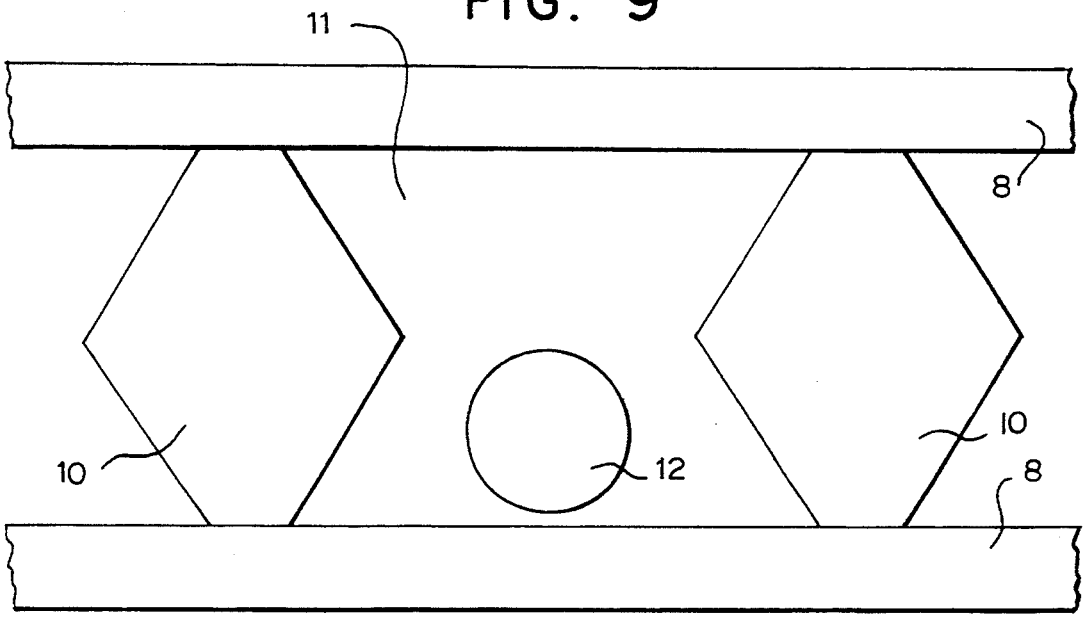
FIG. 9 is an enlarged view of a window according to a further embodiment of the invention.
Figure 10:
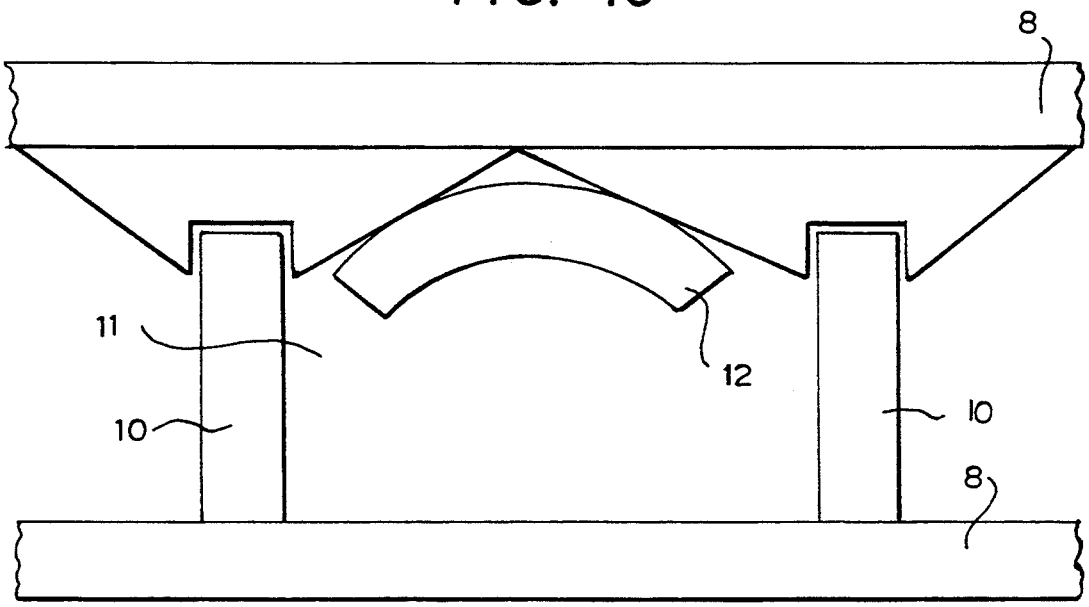
FIG. 10 is an enlarged view of a window according to a still further embodiment of the invention.

The present invention is not limited in either the size or shape of windows 11. Based on the shape of the article to be plated, window 11 can be tailored from any number of cross-bars. FIGS. 9 and 10 illustrate various possible shapes for windows and articles. Depending on the shape of the article, the window can be constructed with as many conductive and non-conductive bars as needed to induce an ideal E/C ratio.

The present invention is not limited to a rack which rotates in 180 degree increments in one dimension. As would be appreciated by one skilled in the art, the present invention could be modified to move in as many as three dimensions and an infinite number of angles. Again, the limitations are only based on the shape of the article.

Figure 11A:
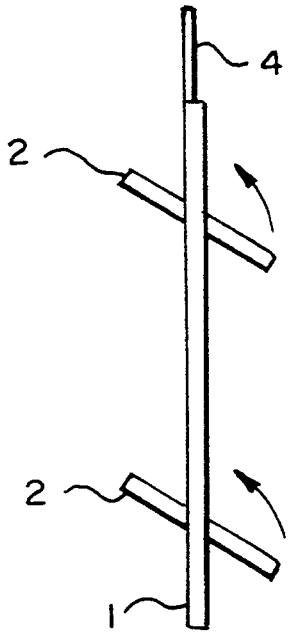
FIG. 11(*a*) is a side view of another embodiment of the rack of FIG. 1 rotated to a first operating position.
Figure 11B:
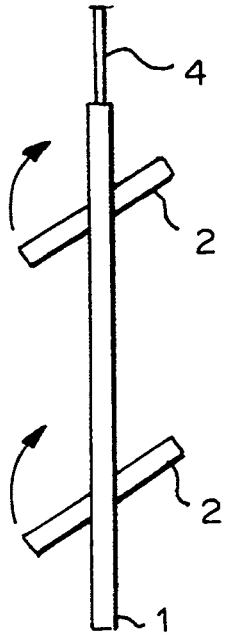

Referring now to FIGS. 11(*a*) and 11(*b*), another embodiment of the invention rotates in alternating directions between first and second operating positions. Arrows indicate the direction of movement between the two operating positions. Each operating position is at an angle to frame 1, and is effective to shift the contact point of an article 12 between differing conductive portions of window 11. Mesh screen 13*a* can be eliminated from this embodiment if the first and second operating positions are no more than 90 degrees off a horizontal plane, as these operating positions only require support for one side of article 12.

Figure 12:
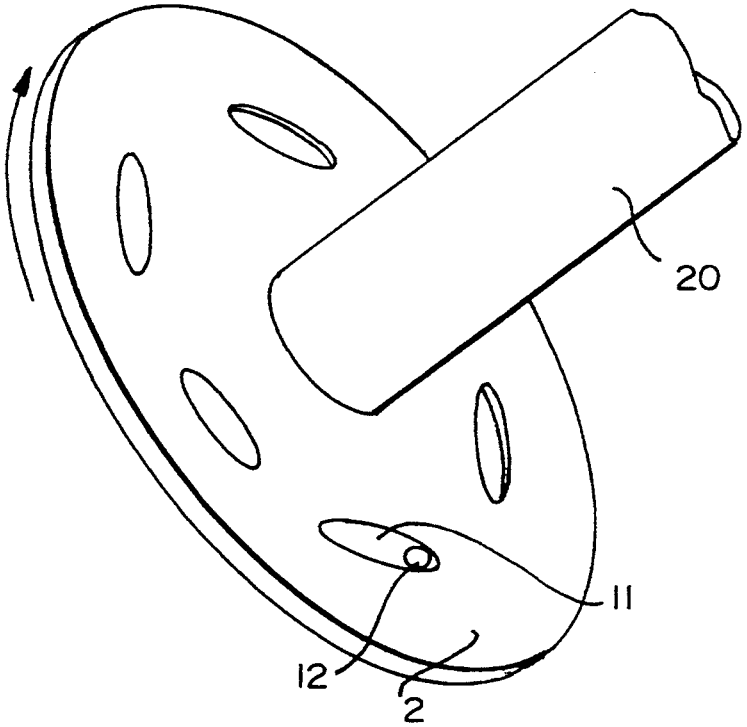
FIG. 12 is a perspective view of a further embodiment of the present invention.

Referring now to FIG. 12, a further embodiment is illustrated. Rotatable rack 2 is circular in shape, and is rotated by a drive shaft 20. Drive shaft is secured to a positioning mechanism (not shown) which can position drive shaft at any position within an operating sphere. Rotatable rack 2 includes windows 11 which are shown as circular, but may have any appropriate shape. This embodiment operates by placing rotable rotatable rack 2 in a desired location via the positioning mechanism, and rotating rotatable rack 2 like a wheel.

Having described preferred embodiments of the invention with reference to the accompanying drawings, it is to be understood that the invention is not limited to those precise embodiments, and that various changes and modifications may be effected therein by one skilled in the art without departing from either the scope or spirit of the invention as defined in the appended claims.

What is claimed is:

1. An apparatus for supporting an article in an electroplating solution comprising:

a rack;

said rack having at least one window;

said window including at least first and second conductive portions on an inner perimeter thereof;

means for retaining said article within said at least one window;

means for rotating said rack between at least first and second operating positions;

said means for rotating including means for permitting said article to move into contact with a point along said at least first and second conductive portions when said rack is in its first operating position;

said means for rotating including means for permitting said article to move into contact with another point of said at least first and second conductive portions when said rack is in its second operating position; and means for connecting said at least first and second conductive portions to a cathode.

2. An apparatus according to claim 1, further comprising:

said article having a thickness A;

said at least first and second conductive portions having a thickness P; and a ratio of A to P to produce a desired edge to center ratio of said article.

3. An apparatus according to claim 1, wherein said means for rotating includes means for rotating said rack in one direction between said at least first and second operating positions.

4. An apparatus according to claim 3, wherein said first and second operating positions are separated by 180 degrees.

5. An apparatus according to claim 1, wherein said means for rotating includes means for rotating said rack in alternating direction betweens said at least first and second operating positions.

6. An apparatus according to claim 5, wherein said at least first and second operating positions are no greater than 90 degrees off a horizontal plane.

7. An apparatus according to claim 1, wherein said means for rotating further comprises;

a drive gear;

a non-conductive driven gear connected to said rack; and a non-conductive drive chain connecting said drive gear to said driven gear.

8. An apparatus according to claim 1, wherein said window further comprising:

said at least one window including a plurality of cross bars;

at least one of said plurality of cross bars is conductive;

said at least one of said plurality of cross bars including said at least first and second conductive portions; and a remainder of said plurality of cross bars is non-conductive.

9. An apparatus for supporting an article in an electroplating solution comprising:

a rack;

said rack having at least one window;

said window including at least first and second conductive portions on an inner perimeter thereof;

means for retaining said article within said at least one window;

said means for retaining includes at least one non-conductive mesh screen closing at least one opening of said window;

means for rotating said rack between at least first and second operating positions;

said means for rotating including means for permitting said article to move into contact with a point along said at least first and second conductive portions when said rack is in its first operating position;

said means for rotating including means for permitting said article to move into contact with another point of said at least first and second conductive portions when said rack is in its second operating position; and means for connecting said at least first and second conductive portions to a cathode.

10. An apparatus for supporting an article in an electroplating solution comprising:

a conductive frame;

at least one rotatable rack mounted on said conductive frame;

said rack having a plurality of conductive cross bars;

said rack having a plurality of non-conductive cross bars;

said plurality of non-conductive cross bars and said plurality of conductive cross bars intersecting to form at least one window for receiving an article;

means for retaining said article in said at least one window;

said at least one window containing at least one of said conductive cross bars;

means for connecting said conductive cross bars to a cathode of a power supply; and means for rotating said at least one rotatable rack between first and second operating positions.

11. An apparatus according to claim 10, wherein said plurality of non-conductive cross bars are vertically disposed in said rack.

12. An apparatus according to claim 10, further comprising;

at least one of said plurality of cross bars is disposed vertically on said rack; and a remainder of said plurality of conductive cross bars is horizontally disposed on said rack.

13. An apparatus for supporting an article in an electroplating solution comprising:

a conductive frame;

at least one rotatable rack mounted on said conductive frame;

said rack having a plurality of conductive cross bars;

said rack having a plurality of non-conductive cross bars;

said plurality of non-conductive cross bars and said plurality of conductive cross bars intersecting to form at least one window for receiving an article;

means for retaining said article in said at least one window;

wherein said means for retaining includes at least one non-conductive mesh screen;

said at least one window containing at least one of said conductive cross bars;

means for connecting said conductive cross bars to a cathode of a power supply; and means for rotating said at least one rotatable rack between first and second operating positions.

14. An apparatus for supporting an article in an electroplating solution comprising:

a conductive frame;

at least one rotatable rack;

first and second shafts for mounting said rack to said frame;

at least one of said first and second shafts are conductive;

said rack including at least one vertical conductive support bar connected to said at least one of first and second shafts;

said rack including horizontal conductive cross bars connected to said at least one vertical conductive support bar;

said rack including vertical non-conductive cross bars;

said horizontal conductive cross bars and said vertical non-conductive cross bars intersecting to form at least one window;

said window having dimensions larger than a dimension of said article;

at least one mesh screen covering said at least one window for supporting and retaining an article placed in said at least one window;

means for connecting said conductive frame to a cathode;

means for rotating said at least one rack between first and second operating positions;

said first position causes said article to contact one of adjacent ones of said conductive horizontal cross bars; and said second operating position causes said article to contact another of said adjacent ones of said conductive horizontal cross bars.

15. An apparatus according to claim 14, wherein said means for rotating includes means for rotating said rack in one direction between said first and second operating positions.

16. An apparatus according to claim 15, wherein said first and second operating positions are separated by 180 degrees.

17. An apparatus according to claim 14, wherein said means for rotating includes means for rotating said rack in alternating direction between said first and second operating positions.

18. An apparatus according to claim 17, wherein said first and second operating positions are no greater than 90 degrees off a horizontal plane.

19. An apparatus according to claim 14, wherein said means for rotating further comprises:

a drive gear;

a non-conductive driven gear connected to said at least one rack; and a non-conductive drive chain connecting said drive gear to said driven gear.

20. An apparatus for supporting an article in an electroplating solution comprising:

a conductive frame;

at least one rotatable rack;

first and second shafts for mounting said rack to said frame;

at least one of said first and second shafts are conductive;

said rack including at least one vertical conductive support bar connected to said at least one of first and second shafts;

said rack including horizontal conductive cross bars connected to said at least one vertical conductive support bar;

said rack including vertical non-conductive cross bars;

said horizontal conductive cross bars and said vertical non-conductive cross bars intersecting to form at least one window;

said window having dimensions larger than a dimension of said article;

at least one mesh screen covering said at least one window for supporting and retaining an article placed in said at least one window;

said article having a thickness A;

means for connecting said conductive frame to a cathode;

means for rotating said at least one rack between first and second operating positions;

said means for rotating including means for permitting said article to move into contact with a point along said at least first and second conductive portions when said rack is in its first operating position;

said at least first and second conductive portions having a thickness P;

a ratio of A to P which produces a desired edge to center ratio of said article;

said first position causes said article to contact one of adjacent ones of said conductive horizontal cross bars; and said second operating position causes said article to contact another of said adjacent ones of said conductive horizontal cross bars.

* * * * *